US006174199B1

(12) United States Patent
Rushing

(10) Patent No.: US 6,174,199 B1
(45) Date of Patent: Jan. 16, 2001

(54) SHAFT MOUNTED EXTENSION CORD SET

(76) Inventor: John A. Rushing, 1165 Tern Dr., Palatine, IL (US) 60067

( * ) Notice: Under 35 U.S.C. 154(b), the term of this patent shall be extended for 0 days.

(21) Appl. No.: 09/346,432

(22) Filed: Jul. 1, 1999

(51) Int. Cl.[7] ..... H01R 13/60; H01R 13/66; H01R 33/94

(52) U.S. Cl. ..... 439/575; 439/654

(58) Field of Search ..... 439/575, 135, 439/142, 144, 148, 367, 654; 362/226

(56) References Cited

U.S. PATENT DOCUMENTS

D. 416,860 * 11/1999 Seiwert et al. ..... 439/502
1,895,656 * 1/1933 Gadke ..... 248/229.26
5,906,517 * 5/1999 Crane et al. ..... 439/654

* cited by examiner

*Primary Examiner*—Neil Abrams
*Assistant Examiner*—Chandrika Prasad
(74) *Attorney, Agent, or Firm*—Kajane McManus

(57) ABSTRACT

The shaft mounted receptacle extension cord set comprises an extension cord including a receptacle head which is received within a housing having a flexible clip thereon which is engageable about a shaft. For protecting an unused receptacle from the ambient environment, a receptacle cover is releasably secured over each receptacle and fixed against loss by a tether secured to the housing.

15 Claims, 8 Drawing Sheets

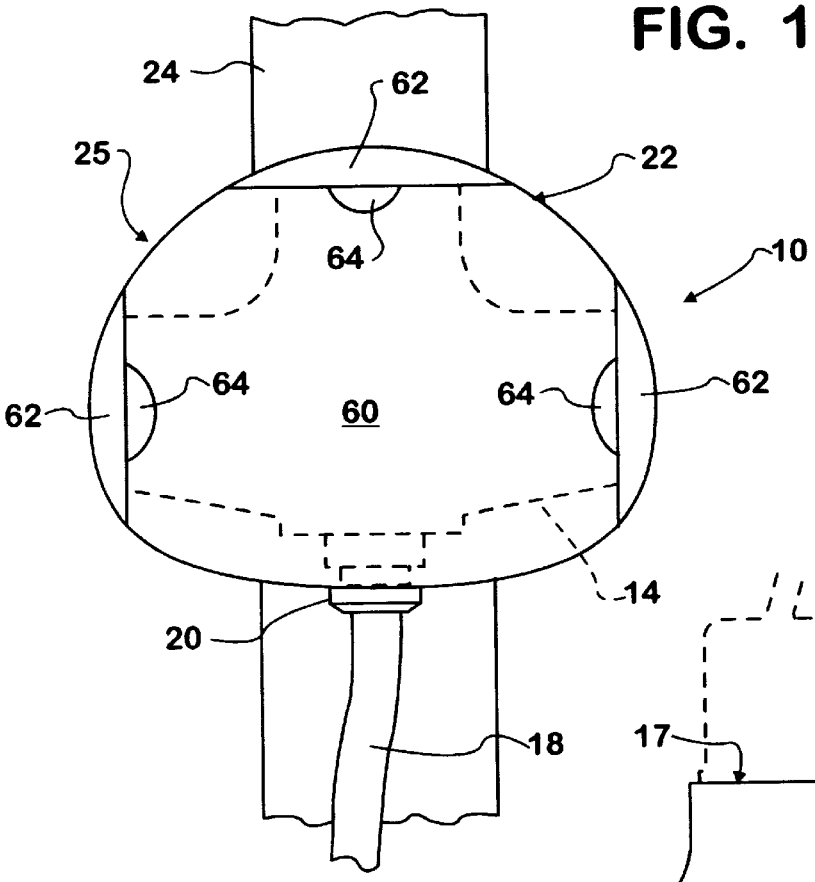
FIG. 1
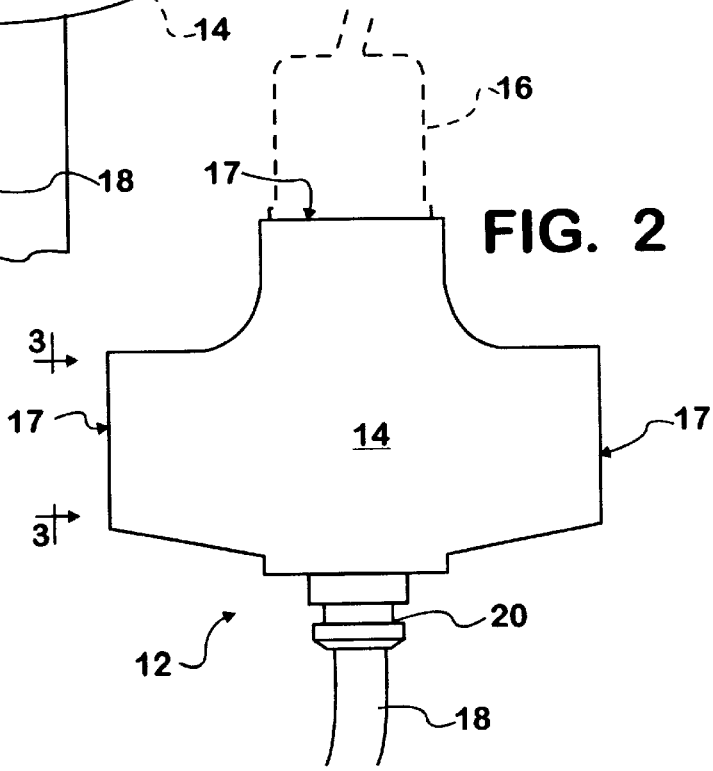
FIG. 2
FIG. 3
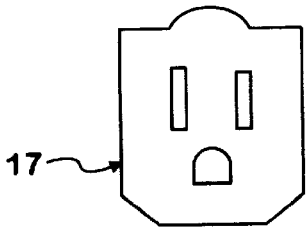

FIG. 4
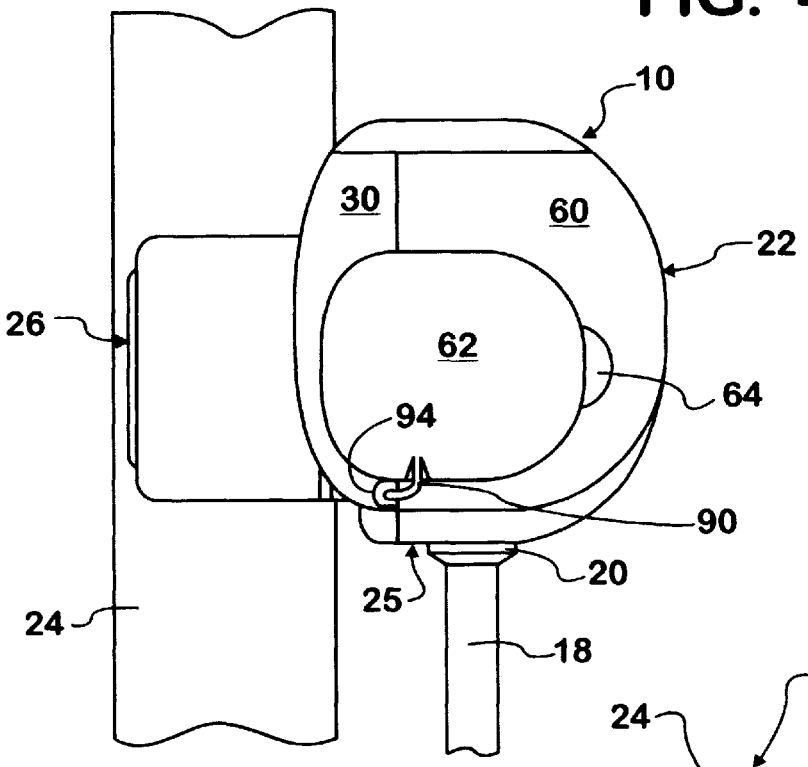
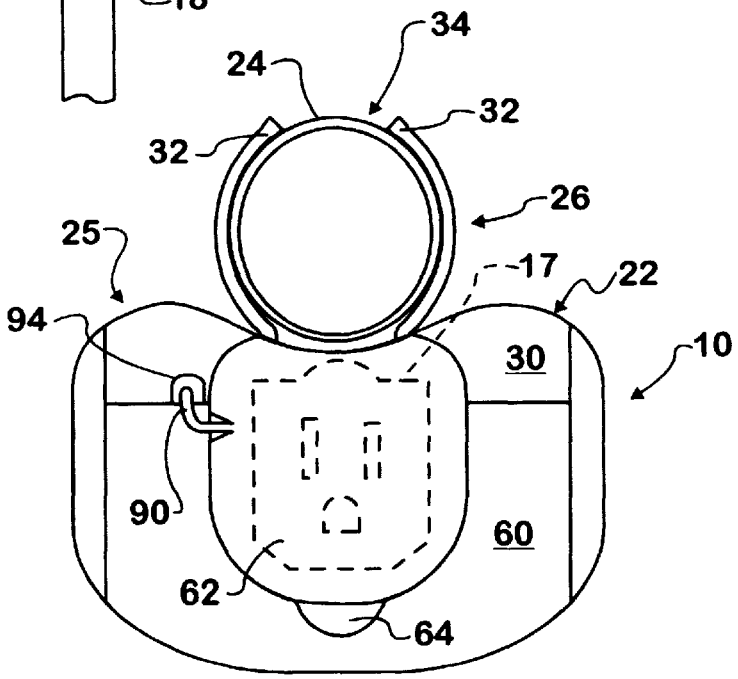
FIG. 5

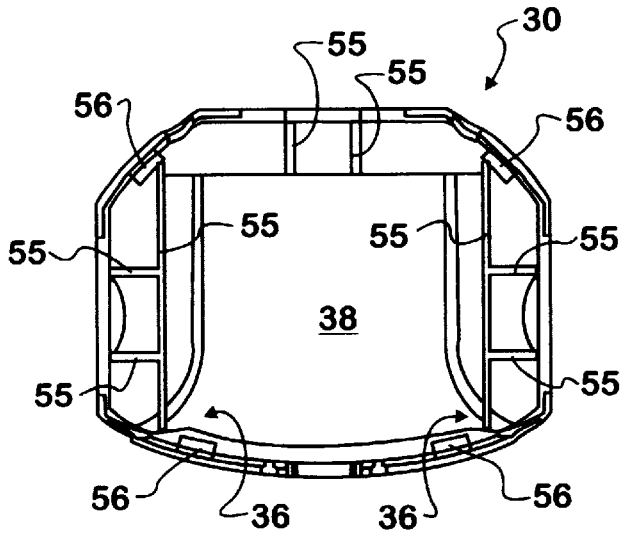
FIG. 9
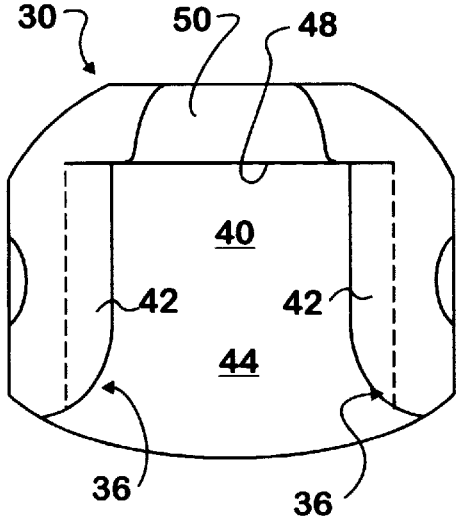
FIG. 10
FIG. 11
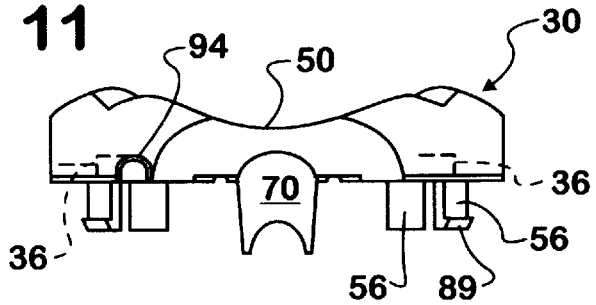
FIG. 12
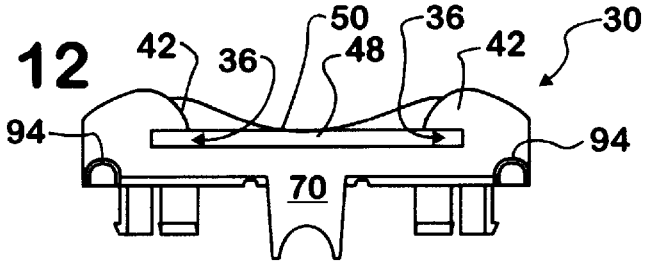

FIG. 13
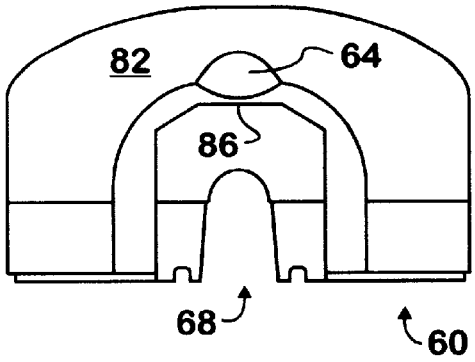
FIG. 14
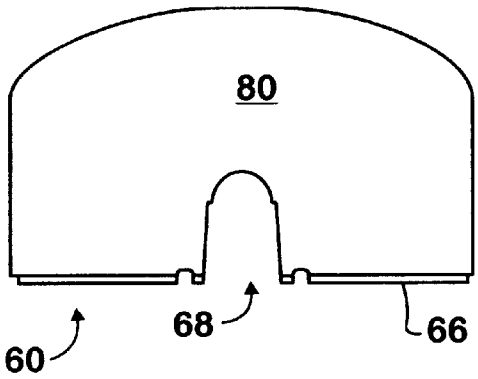
FIG. 15
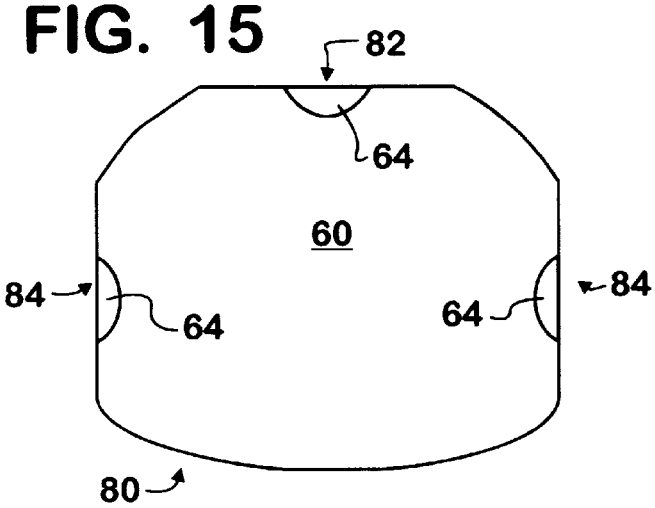
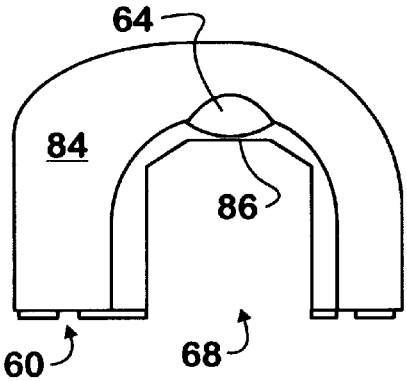
FIG. 16
FIG. 17
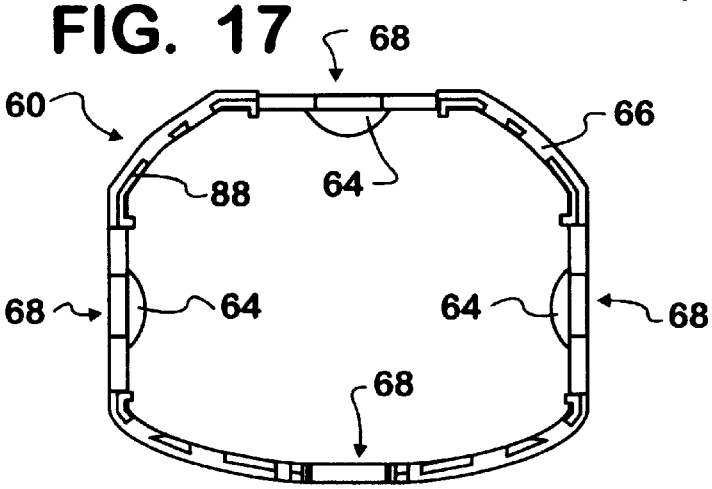

FIG. 18
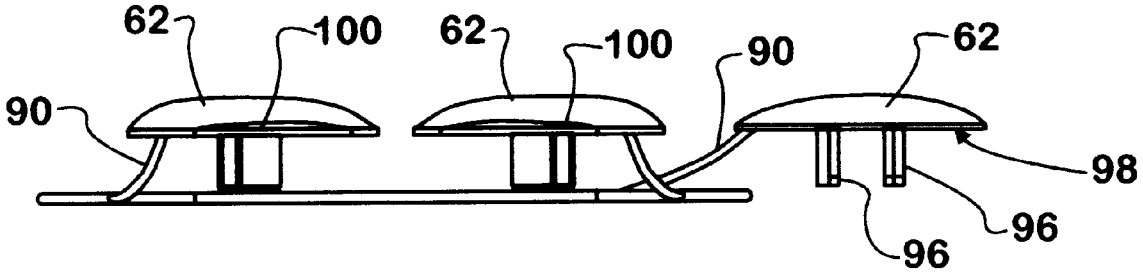
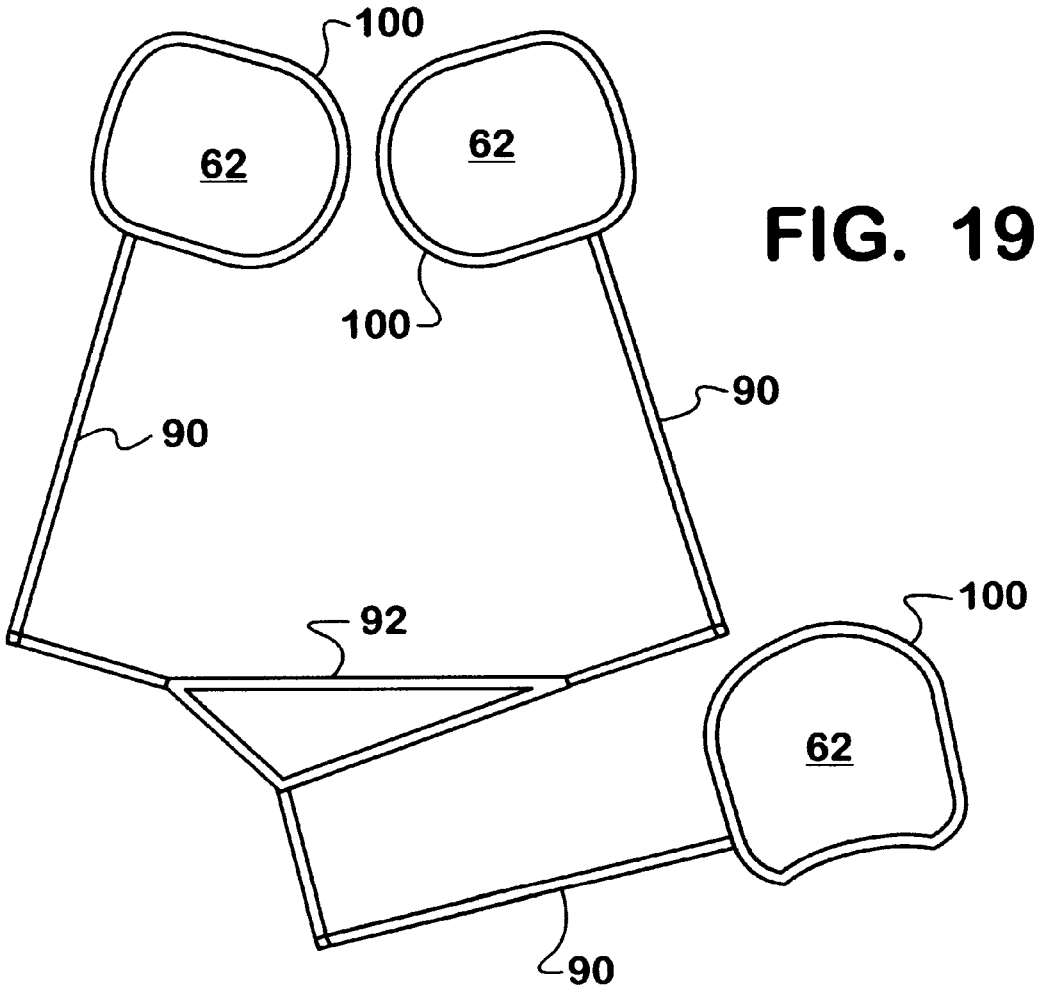
FIG. 19

SHAFT MOUNTED EXTENSION CORD SET

BACKGROUND OF THE INVENTION

1. Field of the Invention

The present invention relates to a shaft mounted extension cord set. More particularly, the cord set includes a housing which allows a receptacle head of the extension cord to be mounted to a shaft, such as, for example, a patio umbrella shaft, a deck rail, a fence pole, or an evergreen tree trunk.

2. Prior art

Heretofore it has been proposed to provide structure for engaging an indoor extension cord head to a limb of an evergreen tree by means of two small straps fixed to and extending from one solid planar surface of the cord head.

As will be described in greater detail hereinafter the cord set of the present invention not only provides a far simpler method of attachment, but also incorporates structure for protecting the receptacle head from the ambient environment when not in use.

Further, in a preferred embodiment, a multireceptable head is provided.

SUMMARY OF THE INVENTION

According to the invention there is provided an extension cord set adapted for mounting to a shaft comprising an extension cord having a head incorporating at least one receptacle which is received within a housing, the housing including a flexible clip which engages about a shaft.

BRIEF DESCRIPTION OF THE DRAWINGS

FIG. 1 is a front view showing a first embodiment of the cord set of the present invention engaged to a vertical rod and showing a multireceptacle head thereof in phantom.

FIG. 2 is a front view of the multireceptacle head.

FIG. 3 is a perspective view of one receptacle of the head taken along line 3—3 of FIG. 2.

FIG. 4 is a side view of the set of FIG. 1.

FIG. 5 is a top plan view of the set of FIG. 1 showing a receptacle thereof in phantom under a receptacle cover of the set.

FIG. 9 is an interior view of a first piece of the housing.

FIG. 10 is an exterior view of the first piece of the housing.

FIG. 11 is a top plan view of the first piece of the housing.

FIG. 12 is a bottom plan view of the first piece of the housing.

FIG. 13 is a top plan view of a second piece of the housing of the set.

FIG. 14 is a bottom plan view of the second piece of the housing.

FIG. 15 is a front view of the second piece of the housing.

FIG. 16 is a side view of the second piece of the housing.

FIG. 17 is an interior view of the second piece of the housing.

FIG. 18 is a side view of a receptacle cover assembly of the set.

FIG. 19 is a top plan view of the receptacle cover assembly of FIG. 18.

DESCRIPTION OF THE PREFERRED EMBODIMENTS

Figure 6:
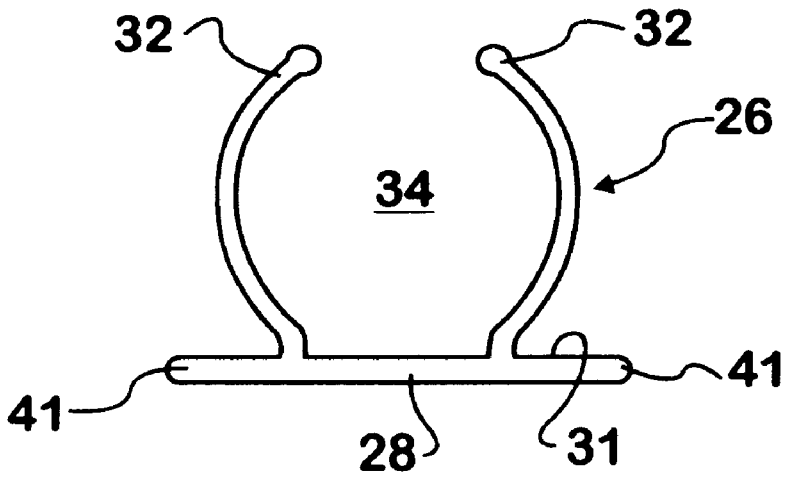
FIG. 6 is a top plan view of a clip of the housing.
Figure 7:
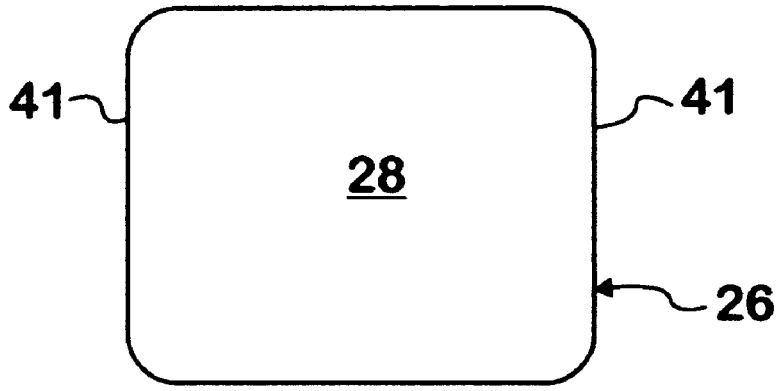
FIG. 7 is a front view of the clip showing a base thereof.
Figure 8:
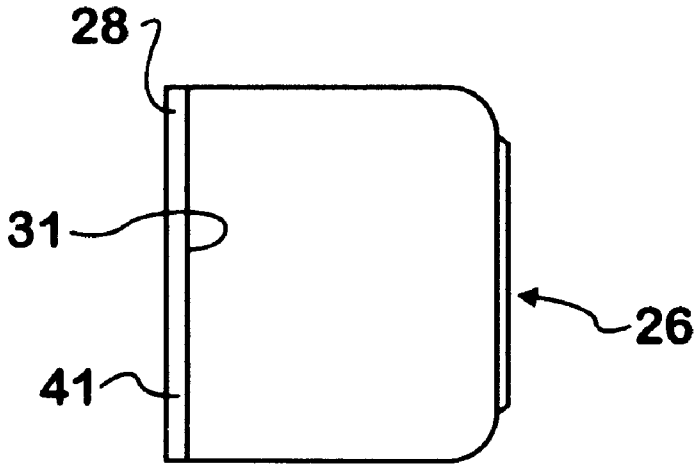
FIG. 8 is a side view of the clip.
Figure 20:
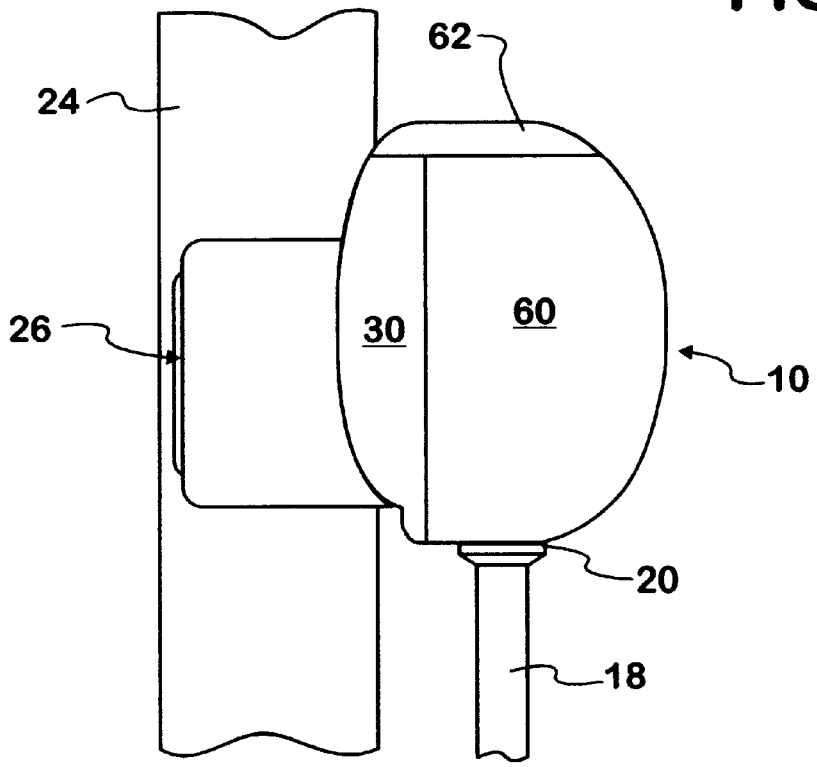
FIG. 20 is a side view of a second embodiment wherein only one receptacle is provided.
Figure 21:
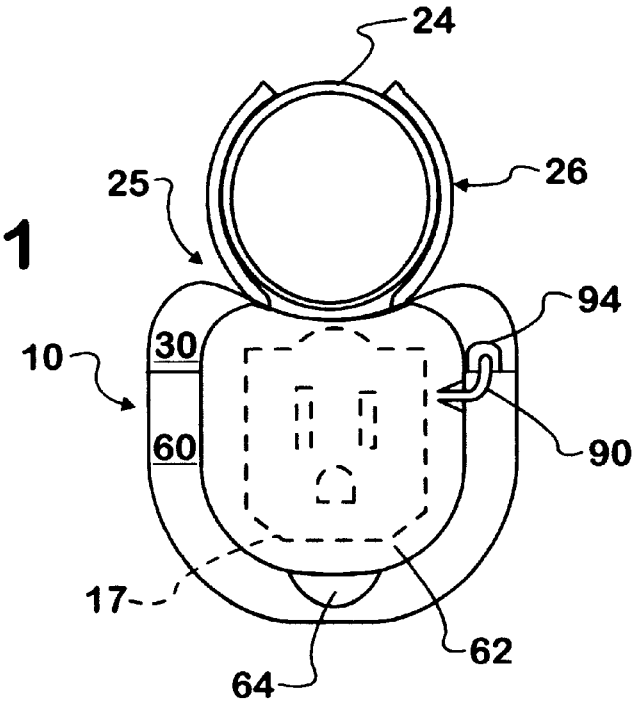
FIG. 21 is a top plan view of the set of FIG. 20 showing the receptacle thereof in phantom under a receptacle cover of the set.

Referring now to the drawing in greater detail, there is illustrated therein the shaft mounted extension cord set made in accordance with the teachings of the present invention and generally identified by the reference numeral 10.

As illustrated in FIGS. 1–19 showing a first embodiment, the set 10 includes an outdoor extension cord 12 having a multireceptacle head 14 which is adapted to engage a plurality of electrical plugs 16, one of which is shown in phantom in FIG. 2, the particular embodiment of the set 10 shown being capable of accommodating up to three plugs 16, by means of three spaced apart receptacles 17, one of which is illustrated in FIG. 3.

The head 14 engages a power cable 18 which is used to plug the cord 12 into an electrical socket (not shown) in known fashion. At a point of juncture between the power cable 18 and the head 14, a strain relief collar 20 is engaged about the cable 18, the collar 20 being provided to stabilize the head 14 within a housing 22 which adapts the head 14 for engagement to a rod 24, such as an outdoor umbrella shaft 24, a trunk of a tree (not shown), or a deck rail (not shown).

As illustrated, the housing 22 comprises a multisectional body 25 incorporating a clip 26 for engaging the body 25 to the rod 24.

Turning first to the clip 26, as best shown in FIGS. 4–8 the structure thereof in the disclosed embodiment includes a planar base 28 which engages a first section 30 of the body 25 of the housing 22 as will be described below. Extending from one planar surface 31 of the base 28 is a pair of flexible cooperating arms 32, which define a rounded space 34 therebetween into and within which the rod 24 is frictionally engaged.

The base 28 is engaged to the body 25 of the housing 22 by sliding the base 28 into a cooperating channel 36 defined in the first section 30 of the body 25 as best shown in FIGS. 9–12.

Turning now to those Figures, a preferred embodiment of the first section 30 of the housing 22 will be found to resemble a half shell in configuration, including an interior surface 38 and an exterior surface 40. The exterior surface 40 includes two side flanges 42 which extend over a center flat 44 thereof, in spaced manner, to provide the channel 36 therebetween by means of which side edges 41 of the clip base 28 are engaged. The channel 36 extends only a portion of the way across the surface 40, forming a detent 48 against sliding of the base 28 too far into the first section 30. Further, to accommodate for engagement of the rod 24, the surface 40 includes an undercut area 50 in an area where the flanges 42 merge into one another, completing the curve accommodated by the arms of 32 of the clip 26, as best illustrated in FIG. 5.

For providing structural integrity, the interior surface 38 of the first section 30 is also shown to incorporate a plurality of ribs 55 which are positioned therealong at various points, to avoid interference with reception of the multireceptacle head 14 within the body 25 of the housing 22. Tabs 56 of a preferred embodiment are also provided engaging the first section 30 to a second section 60, as will be described hereinafter.

Also, as will be described in greater detail hereinafter, the sections 30 and 60 are configured to engage the multireceptacle head 14 so that only the receptacles 17 thereof are exposed to the environment, and then only as desired, through removal of oversized receptacle covers 62 provided for each receptacle 17, with removal thereof being assisted by the provision of indents 64 in the body 25 of the housing 22 at appropriate points relative to each cover 62.

Referring now to FIGS. 13–17, there is illustrated therein various views of a preferred embodiment of the second section 60 of the housing 22 which is seen to approximate a deep hollow cup-like structure 60 of a depth which, when engaged to the first section 30, will accommodate snugly the thickness of the multireceptacle head 14 therewithin.

FIG. 15 provides an exterior view of the second section 60, showing same to be somewhat curved and interrupted at predefined radial points therealong by the indents 64.

FIG. 14 is a bottom plan view of the second section 60 and shows a first opening 68 therein into which the collar 20 is slid, being held in place therein when the first section 30 is engaged to the second section 60 by a finger 70 of the first section 30 as best illustrated in FIG. 12, the finger 70 when engaged within the opening 68, securing the collar 20 within the opening 68 as best illustrated in FIG. 1, partially in phantom.

An opposite or top plan view of the second section 60 is shown in FIG. 13, with the first opening 68 for the collar 20 being now visible in a far bottom wall 80 of the second section 60 with a first receptacle opening 68 being shown in a front wall 82 of the second section 60, this opening 68 engaging a receptacle 17 of the head 14 positioned opposite the collar 20.

FIG. 16 shows a side view of the second section 60, of which an opposite side view would be a mirror image.

As shown, each side wall portion 84 of the second section 60 also incorporates a receptacle opening 68, each receptacle opening 68 being positioned along the rear edge 66 of the second section 60. Thus, in the particular embodiment disclosed, three receptacles 17 are provided by the set 10, with finger slots 64 being provided along a forward edge 86 of each opening 68 engaging a receptacle 17.

Turning to the interior of the second section 60, it will be seen that the rear edge or periphery 66 thereof includes inner ledges 88 therein over each of which a shoulder 89 of a corresponding flexible prong 56 of the first section 30 engages when the sections 30 and 60 are engaged, holding the sections 30 and 60 securely and tightly about the multireceptacle head 14 inserted therebetween, with the collar 20 and abutment between the head 14 and the openings 68 substantially maintaining positioning of the head 14 within the housing 22.

Thus, once the multireceptacle head 14 is engaged appropriately within the housing 22 and the clip 26 is in the defined position, it will be found that the cord set 10 is particularly well suited for mounting to the vertical rod 24.

Further, the cord set 10 has been found to be particularly well suited to use in an outdoor environment, though this should not be construed as limiting.

As relating to outdoor use, it has been found preferable to provide for an unused receptacle 17 to be protected from the environment.

Toward this goal, the cord set 10 is provided with the plurality of receptacle covers 62 which in a preferred embodiment each include a flexible tether 90 fixing the cover 62 to a bridge 92 which is positionable within the housing 22. A slot 94 for each tether 90 is provided in the first section 30 of the housing 22, at a point adjacent the rear edge 66 of the second section 60, and adjacent a corresponding opening 68 in the second section 60.

Each cover 62 comprises an oversized curvilineal disk 62 having a pair of spaced apart parallel prongs 96 extending from a concave inner surface 98 thereof, the prongs 96 being configured to engage the underlying receptacle 17, fixing the cover 62 thereover.

The finger slots 64 are provided to allow for slipping of a fingertip under a lipped edge area 100 of an overlying cover 62 for easing removal thereof, with the cover 62 still maintained engaged to the housing 22 by the tether 90 against loss.

Of course, another option would be to provide each cover 62 with a tether 90 having a free end thereof engaged directly to the housing 22 so the particular embodiment disclosed should not be construed as limiting.

It will be understood, of course, that the cord set 10 would be equally functional if the head 14 of the cord 18 included only a single receptacle 17.

This concept will be clearly understood from a review of FIGS. 20 through 24. In these Figures, although the single receptacle 17 is illustrated as being positioned opposite the collar 20 of the cord 18, this should not be considered limiting as the receptacle 17 would be equally functional in any other desired positioning.

For the sake of brevity, and inasmuch as only minor dimensional changes are required for a cord set 10 to provide a single receptacle 17, only the differences between the embodiments will be touched upon.

Figure 22:
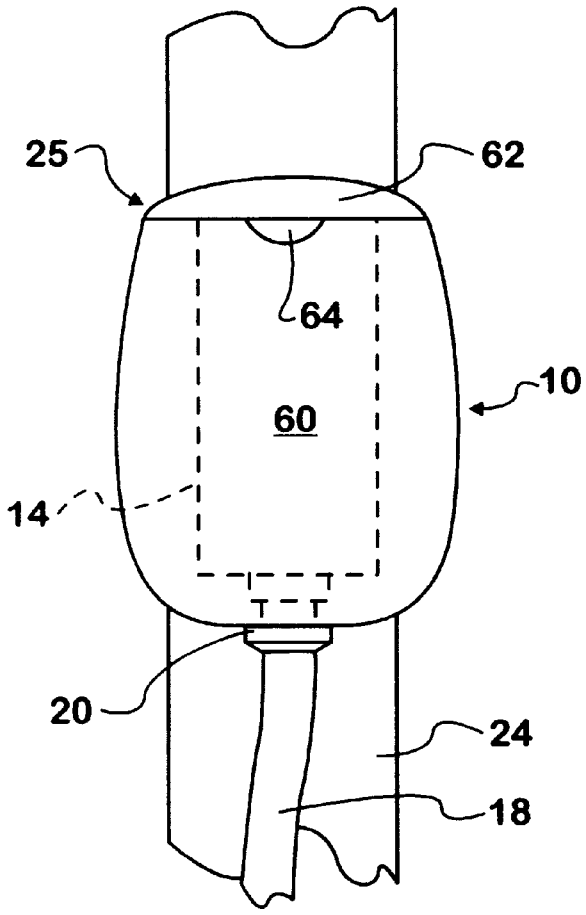
FIG. 22 is a front view of the set of FIG. 20 engaged to a rod and showing a receptacle head thereof in phantom.
Figure 23:
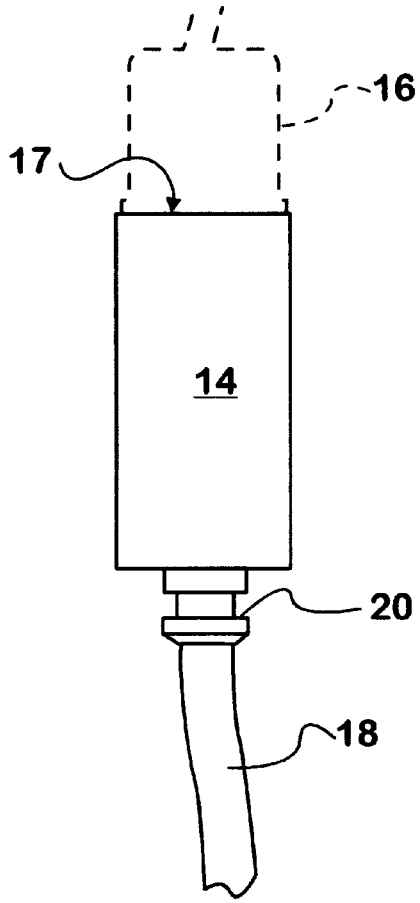
FIG. 23 is a front view of a receptacle head of the set.
Figure 24:
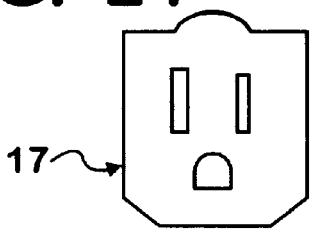
FIG. 24 is a perspective view of the receptacle of the head.

Obviously, since no lateral receptacles 17 are provided in this embodiment, the housing 25 may be narrowed as shown in FIG. 22 to accommodate the smaller receptacle head 14 shown in FIG. 23.

Further, only a single receptacle cover 62 is necessary, with the housing 25 only having two openings 68 (not shown) required, with one corresponding bore 94 being necessary to accommodate the single tether 90 for the single cover 62.

Thus, it will be seen that the cord set 10 is easily adapted to accommodate a head 14 providing any reasonable number of receptacles 17.

As described above, the cord set 10 has a number of advantages, some of which have been described above and others of which are inherent in the invention. Also, modifications may be proposed to the cord set 10 without departing from the teachings herein. Accordingly the scope of the invention should only be limited as necessitated by the accompanying claims.

What is claimed is:

1. An extension cord set particularly adapted for mounting to an outdoor shaft comprises an extension cord having a receptacle head which is received within a housing which protects the receptacle head from the ambient outdoor environment, the housing including a flexible clip which engages about the outdoor shaft.

2. The cord set of claim 1 further including an oversized cover removably engaged over the receptacle.

3. The cord set of claim 2 wherein the cover is fixed against loss by a tether securing the cover to the housing.

4. The cord set of claim 1 wherein the receptacle head includes a plurality of receptacles.

5. The cord set of claim 4 wherein the plurality is at least two.

6. The cord set of claim 1 wherein the housing comprises a body having two sections and a clip.

7. The cord set of claim 6 wherein said clip includes a planar base slidably engaged to the body of the housing.

8. The cord set of claim 7 wherein said base has two substantially convergent semicylindrical cooperating arms extending from a planar surface of said base.

9. The cord set of claim 7 wherein said first body section releasably engages a second body section.

10. The cord set of claim 9 wherein the receptacle head is encased within the housing when the body sections are engaged thereabout.

11. The cord set of claim 10 wherein said housing is interrupted by a plurality of openings.

12. The cord set of claim 11 wherein one of the plurality of openings is sized and configured to engage a cord mounting collar therein.

13. The cord set of claim 12 wherein all but one of the plurality of openings are each sized and configured to engage about a receptacle of the head.

14. The cord set of claim 13 wherein said housing includes a plurality of bores therein equal in number to the number of receptacles of the head, each bore being positioned adjacent a corresponding receptacle opening.

15. The cord set of claim 14 wherein each receptacle cover engages a tether, each tether extending through a bore in the housing the bore being adjacent the receptacle to be covered by the receptacle cover.

* * * * *